US005987930A

United States Patent [19]

Nakai

[11] Patent Number: 5,987,930

[45] Date of Patent: Nov. 23, 1999

[54] METHOD OF JOINING FABRICS ON A FLAT KNITTING MACHINE

[75] Inventor: Syunichi Nakai, Naga-gun, Japan

[73] Assignee: Shima Seiki Manufacturing, Ltd., Wakayama, Japan

[21] Appl. No.: 09/023,482

[22] Filed: Feb. 13, 1998

[30] Foreign Application Priority Data

Feb. 17, 1997 [JP] Japan ..... 9-031003

[51] Int. Cl.[6] ..... D04B 7/00

[52] U.S. Cl. ..... 66/69; 66/70; 66/176; 66/64

[58] Field of Search ..... 66/64, 70, 69, 66/176

[56] References Cited

U.S. PATENT DOCUMENTS

| | | | |
|---|---|---|---|
| 3,668,898 | 6/1972 | Betts et al. . | |
| 5,203,185 | 4/1993 | Okuno . | |
| 5,284,031 | 2/1994 | Stroll et al. | 66/64 |
| 5,377,507 | 1/1995 | Shima | 66/69 |
| 5,487,282 | 1/1996 | Kuhnert | 66/69 |

FOREIGN PATENT DOCUMENTS

| | | |
|---|---|---|
| 3-75656 | 12/1991 | Japan . |
| 2 183 264 | 6/1987 | United Kingdom . |
| 2 228 750 | 9/1990 | United Kingdom . |

*Primary Examiner*—Andy Falik
*Attorney, Agent, or Firm*—Nikaido, Marmelstein, Murray & Oram, LLP

[57] ABSTRACT

In joining fabrics on a flat knitting machine, more specifically joining sleeves to a body, stitch courses are formed on both of the body and the sleeves. A stitch of the edge portion of a sleeve is overlapped with a stitch of the edge portion of the body. Stitch courses are formed on the body and on the edge portions of a sleeve. At least one stitch of the edge portion of the sleeve is overlapped with at least one adjacent stitch of the sleeve. With the decrease in knitting width, when joining the body and sleeve, double stitches are formed in two wales, on the edge portion of the body and on the edge portion of the sleeve.

6 Claims, 11 Drawing Sheets

Prior Art

Prior Art

Prior Art

Prior Art

Prior Art

METHOD OF JOINING FABRICS ON A FLAT KNITTING MACHINE

FILED OF THE INVENTION

The present invention relates to joining fabrics with use of a flat knitting machine, and relates to joining a body and sleeves of knit clothes such as pullover.

PRIOR ART

When plural fabrics are knitted and joined on a flat knitting machine, subsequent sewing processes can be omitted or simplified. When the method is applied to knitting of knit clothes such as pullover, knit fabrics can be seamlessly-knitted in a tubular form on a flat knitting machine.

The present applicant proposed a method of knitting a tubular fabric in Japanese Patent Hei 3-75,656. According to the method, a flat knitting machine with two needle beds is used. A pair of needle beds are arranged to oppose to each other, one in the front of the machine and the other in the rear of the machine. The needles of odd numbers of the front and rear needle beds are assigned to, for example, a front fabric, and the needles of even numbers of the front and rear needle beds are assigned to, for example, a back fabric. With this arrangement, the pair of fabrics are provided, all the time, with empty needles for transfer on the opposing needle beds. As a result, structure patterns such as links, garter and rib, having mixed face stitches and back stitches, can be knitted into a tubular form, and sleeves can be shifted sidewise to from jointed connections between the sleeves and a knitted body.

When a flat knitting machine with four needle beds is used, wherein another pair of needle beds are added, one in the front of the machine and the other in the rear of the machine, front fabrics of sleeves and a body can be knitted on needles of, for example, a lower front needle bed and an upper rear needle bed, and similarly, back fabrics can be knitted on needles of, for example, a lower rear needle bed and an upper front needle bed. In contrast to the case of a flat knitting machine with two needle beds, it is not necessary to assign front fabrics to needles of odd numbers, and back fabrics to needles of even numbers.

The present applicant also proposed methods of joining fabrics on a flat knitting machine in Japanese provisional Patent Hei 2-229,248 (GB2228,750) and Japanese Patent Hei 7-72,384 (U.S. Pat. No. 5,203,185). In Japanese provisional Patent Hei 2-229,248, a flat knitting machine with two needle beds or a flat knitting machine with four needle beds is used. A body and both sleeves are knitted separately in tubular forms up to the level of the arm pits, then the body and both sleeves are knitted and joined together into one large tubular fabric. After that, whenever a desired number of stitch courses are formed, the diameter of the tubular fabric is reduced gradually to knit a knitted cloth such as a pullover having set-in sleeves or raglan sleeves. Here, the sleeves and the body are knitted at the same ratio and joined together. According to Japanese Patent Hei 7-72384, the sleeves are of the set-in type. After the body and both sleeves of a pullover are knitted up to the arm pit, knitting of the sleeves is suspended. Whenever a specified number of courses of the body is knitted, stitches of the sleeves are put on the body to join both fabrics together. During joining, if a stitch of the sleeve is placed over a stitch of a wale positioned in one of second to fourth wales from the edge portion of the body, the appearance of the joint will not be affected.

FIG. 8-A shows the condition of a pullover of which sleeves are of the T-sleeve type before its body and sleeves are joined together. FIG. 8-B shows the condition after joining. FIG. 9 shows a set-in sleeve pullover corresponding to FIG. 8. The sleeve joining angle θ is determined by the height h of the sleeve cap. The T-sleeve has no sleeve cap, and the angle θ is 90 degrees. In the case of the set-in type, when the height of the sleeve cap is increased, the sleeve joining angle θ will be reduced, and the sleeves will sag. A flat knitting machine is used, and knitting starts from rib knitting of the body and sleeves. The body and sleeves are knitted in tubular forms up to the arm pits (points Q0, Q4 and Q6). At the arm pits, the tubular fabrics of the body and those of the sleeves are joined together to form a single large tubular fabric. While stitch courses of the body and the sleeves are knitted, the sleeves are placed on the body and gussets are formed. In the case of T-sleeve, a line connecting the arm pit point Q0 and the point Q1 (the line Q0–Q1) and a line connecting the sleeve point Q3 and the sleeve point Q4 are joined by knitting. In the case of set-in sleeve, the body line Q0–Q1 and the sleeve line Q6–Q7 are joined by knitting to form the gussets. After the formation of the gussets, in the case of T-sleeve, the body line Q1–Q2 and the sleeve line Q4 and Q5 are joined to join the body and the sleeves.

In the case of knitted clothes, the length of the body line Q1–Q2 is designed to have an approximately the same dimension as the knitting width w1 of the sleeve line Q4–Q5 to be joined with or as the knitting width w2 of the line Q7–Q8. In both cases of FIG. 8 and FIG. 9, the number of wales of the sleeves to be joined with the body line Q1–Q2 is the same. In the case of knitted fabrics, differing from woven fabrics, the fabrics are joined by making their stitches overlap with each other. The stitch loop of knitting is long in a sideways direction. For example, when the number of stitches per 10 cm in the transverse direction (direction x) is 34 stitches (wales) and the number in the longitudinal direction (direction y) is 52 (course), the ratio of the transverse length to the longitudinal length of a stitch of the knitted fabric is x:y=0.65:1. Because of this, when the length of the body line Q1–Q2 is designed to have the same dimension as the knitting width w of the sleeve, the number of stitches of the body will be greater by the above-mentioned ratio than that of the sleeve.

Hence the present inventor, considering the ratio of the longitudinal length to the transverse length of the stitch loop, proposed to make the joint in such a case as mentioned above, by overlapping two stitches (wales) of the sleeve with stitches of three courses of the body. This method is shown in FIG. 10 through FIG. 12. These diagrams show an example of joining by knitting, of sleeves and a body of a set-in sleeve pullover. FIG. 10 shows the sequence of joining by knitting between a body 117 and sleeves 113 and 115 after the knitting of the gussets. The yarn is fed in the direction of the arrow. When the yarn completes a round, three stitch courses are formed on each of the front and back bodies 117 and one stitch course on each of the front and back sleeves 113 and 115.

In FIG. 11, the steps of joining by knitting between the front body 117*f* and the front sleeves 113*f* and 115*f* of FIG. 10 are shown in detail. The example is a solid pullover. Alphabetical letters A through p indicated in the bottom of the diagram show the needles of odd numbers of the front needle bed, and dots between alphabetical letters show needles of even numbers. State s indicates how the stitches of the respective parts are held on the needle bed at the starting point. The stitches of the front right sleeve 113*f* are held on the needles A~K of the front needle bed, the stitches of the front body 117*f* are held on the needles L~e, and the stitches of the front left sleeve 115*f* are held on the needles f~p. The stitch course of the front left sleeve is indicated by mark 120, and the stitches of the body are shown by black circles. In FIG. 12, the structure of stitch loops in the joint between the front left sleeve 115 and the front body 117*f* is shown partially.

First, in step 1, the yarn is fed to needles A~e holding the stitches of the left sleeve 113*f* and those of the front body 117*f* to form a stitch course 121. In step 2, the yarn is shifted to the left to feed the yarn to the needles e~L to form the subsequent stitch course 122 of the front body 117*f*. In steps 3~5, joining between the front left sleeve 115*f* and the front body 117*f* is shown. The entire left sleeve is shifted to the left, and the stitches 133, 134 of the front left sleeve 115*f* being held on the needles f, g are made to overlap with the stitches 131, 132 of the front body 117*f* being held on the needle d, e to reduce the knitting width of the left sleeve 115*f* by two wales. Steps 3, 5 are transfers of the stitches 131, 132 of the body 117*f* to position the stitches 133, 134 of the sleeve 115*f* on the face side of the double stitches 150, 151.

In step 6, the yarn is shifted to the right to feed the yarn to the needles L~n to knit a stitch course 123 on the front body 117*f* and the front left sleeve 115*f*. The subsequent steps 7~9 correspond to the above-mentioned steps 3~5; in these steps, the right sleeve 113*f* and the front body 117*f* are joined together. By these steps 1~9, three stitch courses are formed on the front body 117*f* and one stitch course is formed on each of the sleeves 113*f*, 115*f*. At the same time, two stitches (wales) of each of the sleeves 113*f*, 115*f* are joined with the front body 117*f* to reduce their knitting widths. When this knitting is repeated subsequently, the sleeves and the body are joined together. Marks 150~155 in FIG. 12 indicate double stitches. Although not illustrated herein, in place of the above-mentioned joining by knitting, two stitches of the sleeve may be divided and overlapped, one at a time, with the body whenever a stitch course is formed on the body.

According to the joining method, however, stitches of the sleeves 113*f*, 115*f* are overlapped with the stitches of the edge portion wales of the body repeatedly, in the above-mentioned example, with the stitches being held on the needles L, M and the needles d, e. As double stitches are formed continuously on plural number of stitches of the same wales to reduce the knitting widths of the sleeves, double stitches will be concentrated along the joint as shown in FIG. 12. The present inventor found that the stitches of these wales were not arranged evenly, and the wales were distorted into the form of the letter C." The present inventor also found that since the number of stitches (wales) of the sleeves to be joined were smaller than the number of stitches (courses) of the body, stitches of the body that did not overlap with the stitches of the sleeves generated holes, affecting the appearance of the joints.

SUMMARY OF THE INVENTION

One object of the present invention is to improve the method of joining between fabrics knitted with the use of a flat knitting machine and improve the appearance of the joints.

Another object of the present invention is to improve the method of joining between fabrics that have approximately the same dimensions of knitting width and knitting length, for example, joining between a body and sleeves, to produce a joint of good design.

The present invention is a method of joining fabrics, with use of a flat knitting machine wherein at least a pair of needle beds extending sidewise and opposing against each other, one in the front and the other in the rear, are provided, each of said pair of needle beds has a large number of needles, said pair of needle beds form a trick gap between them, at least one of said pair of needle beds can be racked sidewise, and stitches can be transferred between said pair of needle beds, said method of joining fabrics comprising:

(a) knitting a first fabric and a second fabric side by side by using specified needles of the needle beds;

(b) continuously feeding the yarn to the needles holding the first fabric and the needles holding stitches of an edge portion of the second fabric, said edge portion being adjacent to the first fabric, to form a stitch course on the first fabric and the edge portion of the second fabric;

(c) overlapping, by stitch transferring, at least one stitch of the edge portion of the second fabric with at least one adjacent stitch of the same fabric to reduce the knitting width of the second fabric; and (d) overlapping, by stitch transferring, at least one stitch of the edge portion of the first fabric with at least one stitch of the edge portion of the second fabric to reduce the knitting width of the second fabric.

Preferably, said at least one stitch each is one stitch each.

Preferably, in step (b) two stitches of the edge portion of the second fabric and two adjacent stitches of the second fabric are overlapped with each other; one stitch of the former is overlapped with one stitch of the latter.

Preferably, in said step (b) the yarn is fed to two to ten needles of the edge portion of the second fabric.

The present invention is also characterized in that said first fabrics which include consists of two fabrics, a front fabric of a body and a back fabric of the body and, said second fabric consists of four fabrics including a front fabric of a right sleeve, a back fabric of the right sleeve, a front fabric of a left sleeve the method further comprising and a back fabric of the left sleeve, (e) in said step (a), the front fabric of the body and the front fabric of the right sleeve, the front fabric of the body and the front fabric of the left sleeve, the back fabric of the body and the back fabric of the right sleeve, and the back fabric of the body and the back fabric of the left sleeve are knitted;

(f) in said step (b), the front fabric of the body and the edge portion of the front fabric of the right sleeve on the side of the front fabric of the body, the front fabric of the body and the edge portion of the front fabric of the left sleeve on the side of the front fabric of the body, the back fabric of the body and the edge portion of the back fabric of the right sleeve on the side of the back fabric of the body, and the back fabric of the body and the edge portion of the back fabric of the left sleeve on the side of the back fabric of the body are knitted; and (g) through combination of steps (e), (f), the front fabric of the body and the back fabric of the body, and the front fabric of the right sleeve, the back fabric of the right sleeve, the front fabric of the left sleeve and the back fabric of the left sleeve, and edge portions of the front fabric of the right sleeve, the back fabric of the right sleeve, the front fabric of the left sleeve and the back fabric of the left sleeve on the side of the body are knitted.

Preferably, in step (e), the front fabric of the body and the front fabric of the right sleeve, and the front fabric of the body and the front fabric of the left sleeve are knitted, and during this only the front fabric of the body is knitted, and the back fabric of the body and the back fabric of the right sleeve, and the back fabric of the body and the back fabric of the left sleeve are knitted, and during this only the back fabric of the body is knitted.

It is shown in FIG. 2 and FIG. 5 that knitting suitable for seamless knitting can be made by combining these knitting operations. Specific combinations of knitting operations are discretionary. With regard to knitting in step (a), as shown in FIG. 1 and FIG. 5, knitting of the edge portion of the sleeve of the opposite side may be added. For example, the edge portion of the right front sleeve and the front body and the entire left front sleeve may be knitted. With regard to knitting in step (b), as shown in FIG. 2 and FIG. 5, edge portions of the sleeves on both sides may be knitted. For example, the edge portion of the right front sleeve and the front body and the edge portion of the left front sleeve may be knitted.

As an example, tubular seamless knitting of a pullover or the like will be explained. A right sleeve and a left sleeve and a body are held side by side on a front needle bed and a back needle bed. Needles of the needle beds are assigned to the right and left sleeves and the body. The right and left sleeves and the body are knitted, starting from rib parts, in tubular forms, respectively, up to the arm pit. After that, the yarn is fed to the needles holding the stitches of the left sleeve (or the right sleeve), the body, the right sleeve (or the left sleeve) to form a stitch course on the front of each tubular fabric, next, the yarn is fed to needles holding the stitches of the right sleeve (or the left sleeve), the body and the left sleeve (or the right sleeve) to form a stitch course on the back of each tubular fabric. This process is repeated to circum-knit tubularly knitted sleeves and body as a single large tubular fabric. There is no need of making this circum-knitting with a single yarn. The yarn may be changed in the middle of circum-knitting. During circum-knitting, stitches of the sleeves and stitches of the body are successively overlapped with each other by stitch transfer to join the sleeves and the body by knitting, and at the same time, the knitting widths of the tubular fabrics are reduced.

According to the present invention, during the circum-knitting, the body can be made to have a greater number of courses than that of the sleeves. When a stitch course is formed on the body, the yarn is also fed to needles holding an appropriate number of wales of the edge portion of a sleeve adjacent to the body to form a stitch course on the edge portion of the sleeve. Then, the stitches formed on the edge portion of the sleeve and stitches that are adjacent to them and on which the stitch course were not formed are overlapped with each other, by stitch transfer, to reduce the knitting width of the sleeve. Further, the stitches formed on the edge portion of the sleeve and the adjacent stitches of the body are overlapped with each other, by stitch transfer, to reduce the knitting width of the sleeve.

Next, the operation and effects of the present invention will be described. When a stitch course is added to the edge portion of the second fabric or the sleeve, the number of stitches around the joint will be increased. Stitches of the edge portion and adjacent stitches of the same fabric are overlapped with each other to reduce the knitting width, and stitches of the edge portion of the same fabric and stitches of the first fabric or the body are overlapped with each other to reduce the knitting width. As a result, a group of stitches of the edge portion of the sleeve of which course number has been increased are arranged along the joint, and double stitches are formed dispersedly on both sides of the group of stitches of the edge portion. Hence double stitches are not concentrated on stitches of specific wales of the joint. Thus the appearance of the joint of the fabrics will be improved.

As described above, according to the joining method of the present invention, when two fabrics are to be joined together, the number of stitches of the edge portion is increased to dispersedly form double stitches, and as a result, the appearance of the joint of the fabrics is improved. Moreover, the joint can exhibit design effect such as that of a fashion line.

BRIEF DESCRIPTION OF THE DRAWINGS

FIG. 9-A shows the state before joining, and FIG. 9-B shows the state after joining.

EMBODIMENT

An embodiment of the present invention will be described with reference to FIG. 1 through FIG. 4. In this embodiment, sleeves 3, 5 and a body 7 of a set-in sleeve pullover 1 comprising a tubularly seamless-knitted solid plain stitch structure are joined on a flat knitting machine with two needle beds. This flat knitting machine must meet the following conditions: At least a pair of needle beds extending sidewise and opposing against each other, one in the front and the other in the rear, are provided, each of said pair of needle beds has a large number of needles, said pair of needle beds form a trick gap between them, at least one of said pair of needle beds can be racked sidewise, and stitches can be transferred between said pair of needle beds. For knitting a pullover, as is the case of the embodiment, it is desirable to use a computerized flat knitting machine SWG-V (SWG-V" is a trade name of Kabushiki Kaisha Shima Seisakusho).

Figure 1B:
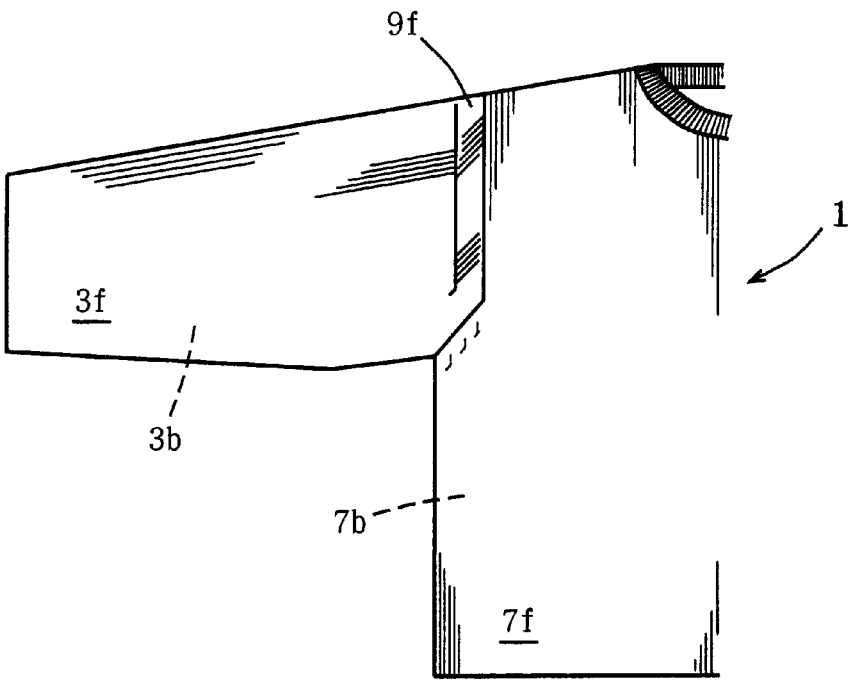
FIGS. 1A and B shows a sleeve and a body of a set-in sleeve pullover knitted by the first embodiment of the present invention.
FIG. 1-A shows the state before joining, and FIG. 1-B shows the state after joining.
Figure 1A:
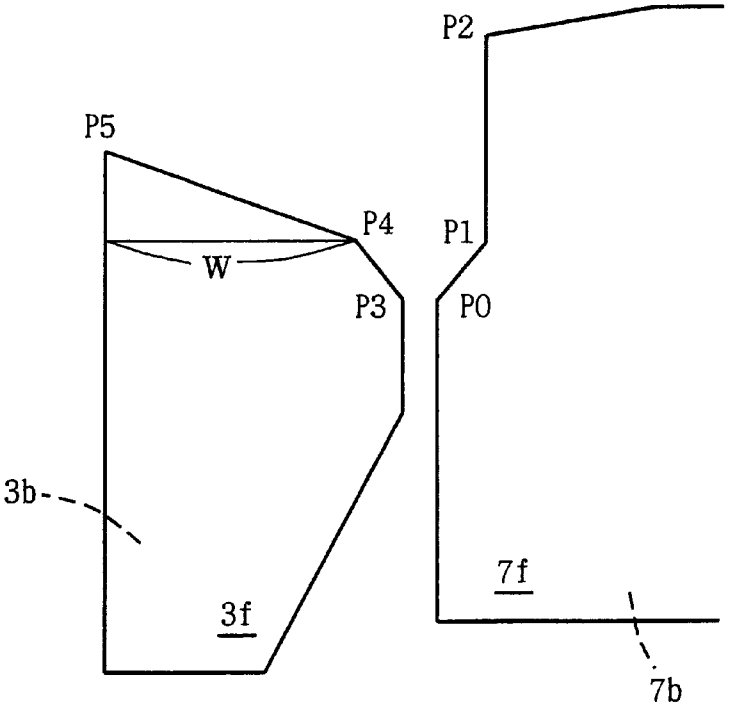
Figure 2:
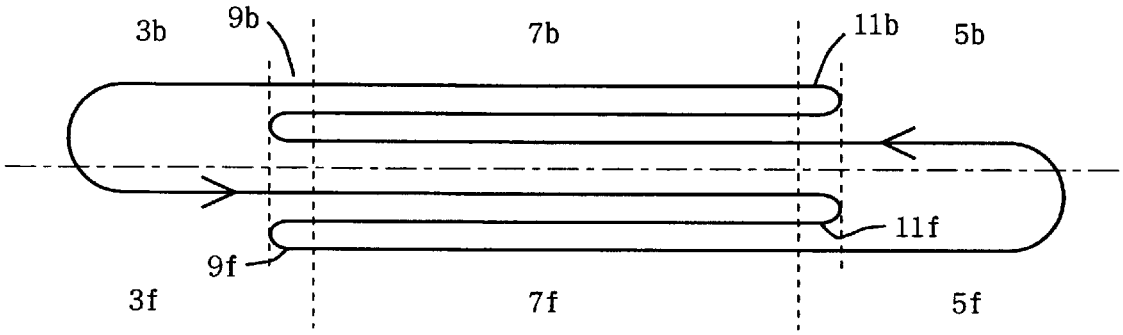
FIG. 2 shows the knitting sequence when, in the above-mentioned embodiment, the body and the sleeves are joined and knitted as a large tubular fabric.
Figure 3:
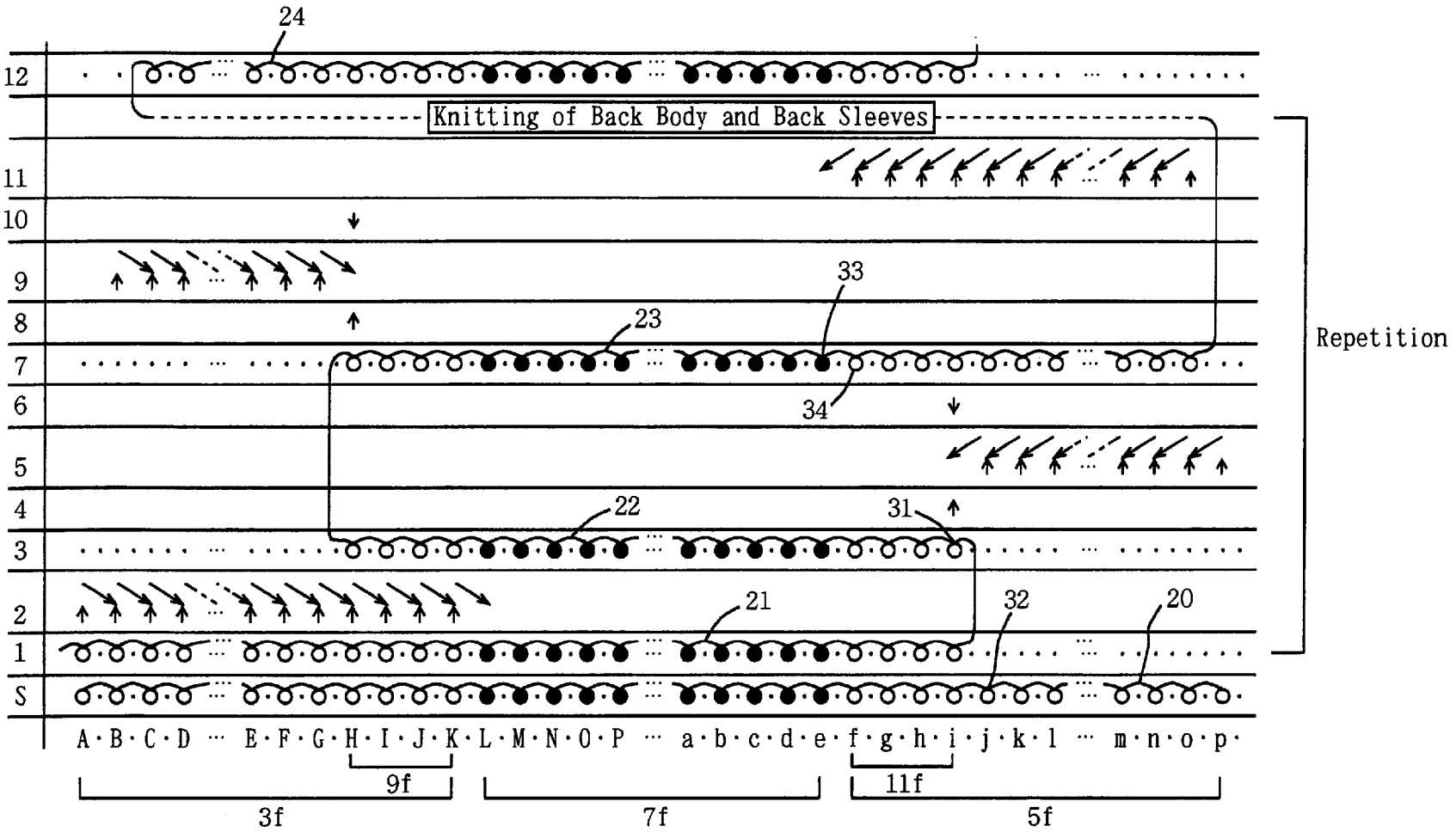
FIG. 3 shows the knitting steps of the front fabric side (front body, front right sleeve and front left sleeve).
Figure 4:
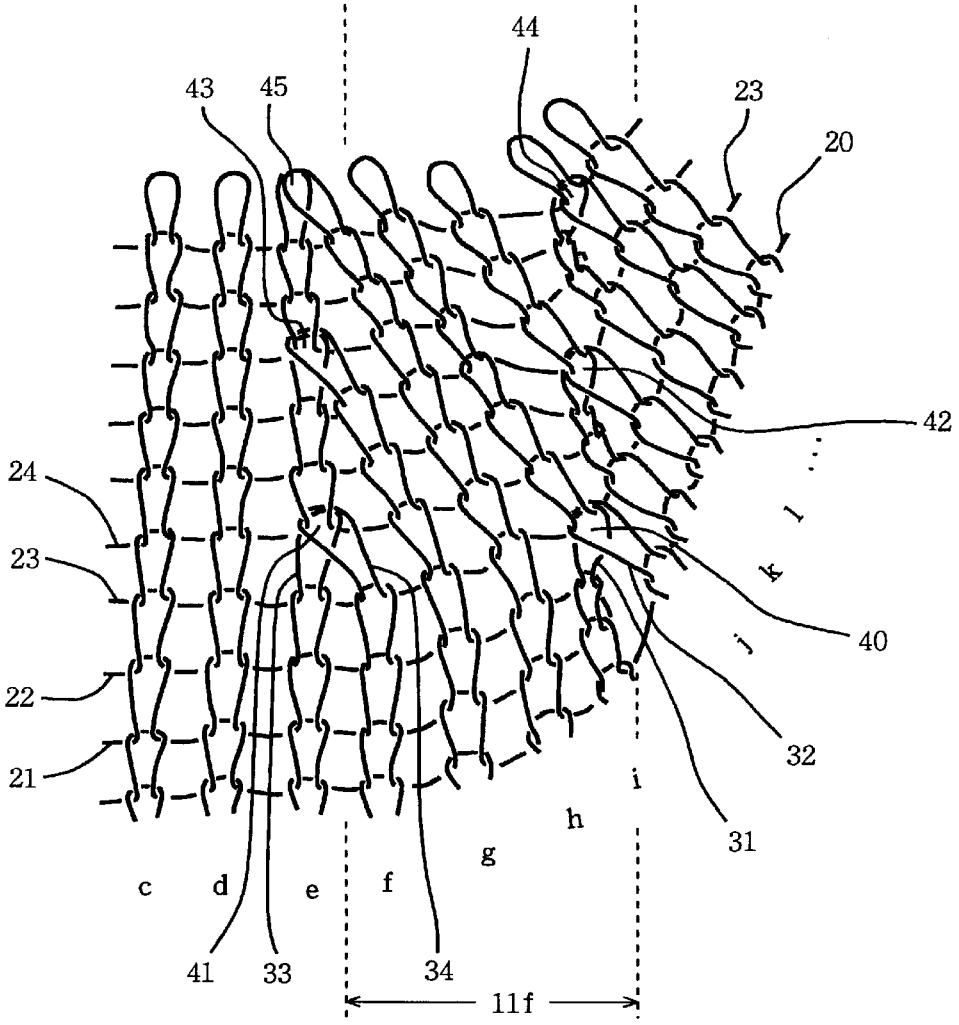
FIG. 4 shows the structure of stitch loops of the joint of the left sleeve and the front body in the first embodiment.

FIG. 1 shows the right half of a pullover to be knitted bisymmetrically. FIG. 1-A shows the state before joining the right sleeve 3 and the body 7, and FIG. 1-B shows the state after joining. FIG. 2 shows the knitting sequence when the line P1–P2 of the body 7 and the line P4–P5 of the sleeve are joined by knitting after the body 7 and the sleeves 3,5 were knitted into tubular forms, respectively. The yarn is fed in the direction of the arrow. When the yarn completes a round, three stitch courses will be formed on each of the front body 7*f* and the back body 7*b*, and one stitch course on each of the front and back sleeves 3*f*, 3*b*, 5*f*, 5*b*, and three stitch courses on edge portions 9*f*, 9*b*, 11*f*, 11*b* of the sleeves 3*f*, 5*f*, respectively. FIG. 3 shows joining knitting of the front fabrics (front body 7*f*, front right sleeve 3*f*, and front left sleeve 5*f*) of FIG. 2. The alphabetical letters A~p shown in the bottom of the diagram indicate the needles of odd numbers of the front needle bed. Stitches of the front right sleeve 3*f* are held on needles A~K. Stitches of the front body 7*f* are held on needles L~e. Stitches of the front left sleeve 5*f* are held on needles f~p, respectively. The dots between the alphabetical letters indicate needles of even numbers, and these needles are used to knit the back fabrics (back body 7*b*, back right sleeve 3*b*, and back left sleeve 5*b*) that are not illustrated. FIG. 4 shows the stitch loop structure of the joints between the front left sleeve 5*f* and the front body 7*f*. It should be noted that when stitch courses are knitted on the body, the needles H~K and needles f~i are used to concurrently knit stitches of four wales on each of the edge portions 9, 11 of the left and right sleeves 3, 5 adjacent to the body 7. S in the diagram shows the state of stitches being held on the needle bed before step 1, and the stitch course here is indicated by mark 20.

First, in step 1, the yarn is fed to needles A~e holding the stitches of the front right sleeve 3*f* and the stitches of the front body 7*f* and successive needles f~i holding stitches of the edge portion 11*f* of the front left sleeve 5*f* to form a stitch course 21. In step 2, the entire front right sleeve 3*f* being held on the needles A~K is shifted to the right to overlap the stitch on the needle K of the sleeve with the stitch on the needle L of the body to reduce the knitting width of the right sleeve by one wale. In step 3, the yarn is shifted to the left and fed to needles i~f holding the stitches of the edge portion 11*f* of the left sleeve, needles e~L holding the stitches of the front body 7*f*, and needles K~H holding the stitches of the edge portion 9*f* of the right sleeve, to form the stitch course 22 on the front body 7*f* and the edge portions 9*f*, 11*f* of the respective sleeves. In steps 4~6, the stitches being held on needles j~p of the left sleeve 5*f* not including the edge portion 11*f* are shifted to the left, and the stitch 32 being held on the needle j is overlapped with the stitch 31 being held on the needle i of the edge portion 11*f*, to form a double stitch 40 of FIG. 4. Steps 4, 6 are for transferring the stitch 31 being held on the needle i of the edge portion 11*f* so as to position the stitch 32 being held on the needle j on the face side of the double stitch 40.

In stitch 7, the yam is shifted to the right, to feed the yarn to the needles H~K holding the stitches of the edge portion 9*f* of the right sleeve, the needles L~e holding the stitches of the front body 7*f*, and the needles f~o holding the stitches of the left sleeve 5*f*, to form the stitch course 23 on these parts. In steps 8~10, just like in steps 4~6 mentioned above, the front right sleeve 3*f* is narrowed to reduce the knitting width by one wale. In step 11, just like in step 2 above, the left sleeve 5*f* is shifted towards the body 7, the entire left sleeve 5*f* being held on needles f~o is shifted to the left, and the stitch 34 being held on the needle f is overlapped with the stitch 33 being held on the needle 4 of the body 7*f* to reduce the knitting width of the left sleeve by one wale.

After the completion of step 11, the sleeves 3*b*, 5*b* of the back side and the body 7*b* are joined. This joining is made by the same method as that used in knitting the sleeves and the body on the front side, hence the explanation is omitted. With the steps 1~11 described above, three stitch courses are formed on the front body 7*f*, one stitch course is formed on the sleeves 3*f*, 5*f* except their edge portions, and three stitch courses are formed on the edge portions 9*f*, 11*f* of the sleeves. One stitch of each sleeve is overlapped with one stitch of the body, and another stitch of each sleeve is overlapped with one stitch of the edge portion of the sleeve, hence the knitting width of each sleeve is reduced by two wales. When this knitting is repeated, the sleeves and the body will be joined together. Marks 40~45 of FIG. 4 indicate double stitches formed dispersedly on either side.

Figure 12:
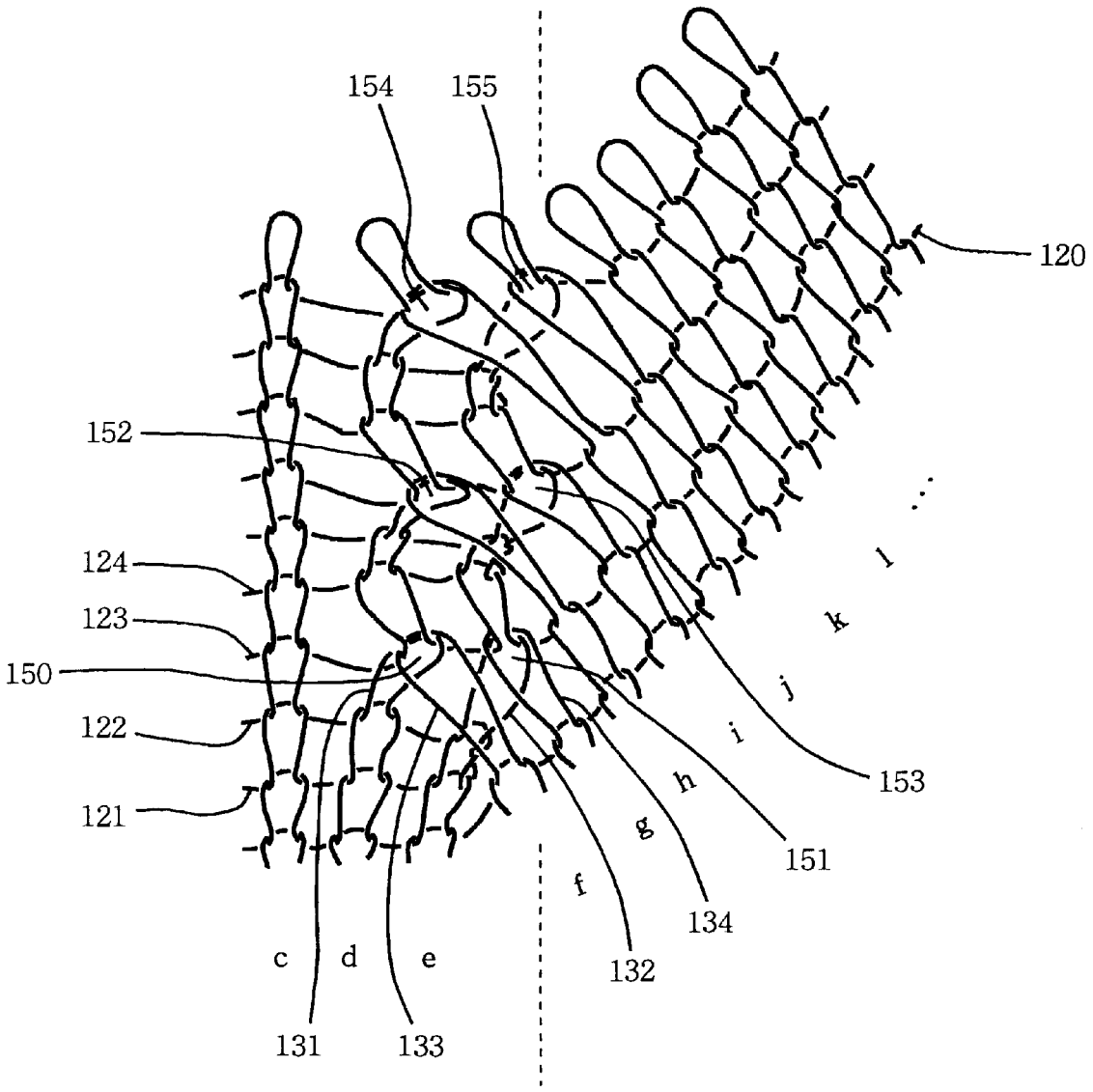
FIG. 12 shows the prior art stitch loop structure of the joint between the left sleeve and the front body by the knitting steps of FIG. 11.

In this way, knitting of the body and only the edge portions of the sleeves only is made to increase the number of stitch courses of the sleeves around the joints. Then a newly formed stitch of the edge portion of the sleeve is overlapped with an adjacent stitch of the sleeve to reduce the knitting width of the sleeve within the sleeve itself. Further, a stitch of the edge portion of the sleeve is overlapped with a stitch of the body to reduce the knitting width of the sleeve on the boundary between the sleeve and the body. As a result, the group of stitches of the edge portion of the sleeve of which course number has been increased are arranged along the joint, and the double stitches are formed dispersedly on both ends of the stitch group of this edge portion. The stitches additionally formed on the edge portion of the sleeve serve to buffer, hence the joint between the sleeve and the body will be moderated. As a result, double stitches do not concentrate on particular wales of the joint, which was the case in the prior art (see FIG. 12), and the appearance of the joint of the fabrics is improved. Moreover, the stitches of the edge portion of the sleeve having a specified number of wales and the double stitches serve as design elements like fashion lines.

Modification

Figure 5:
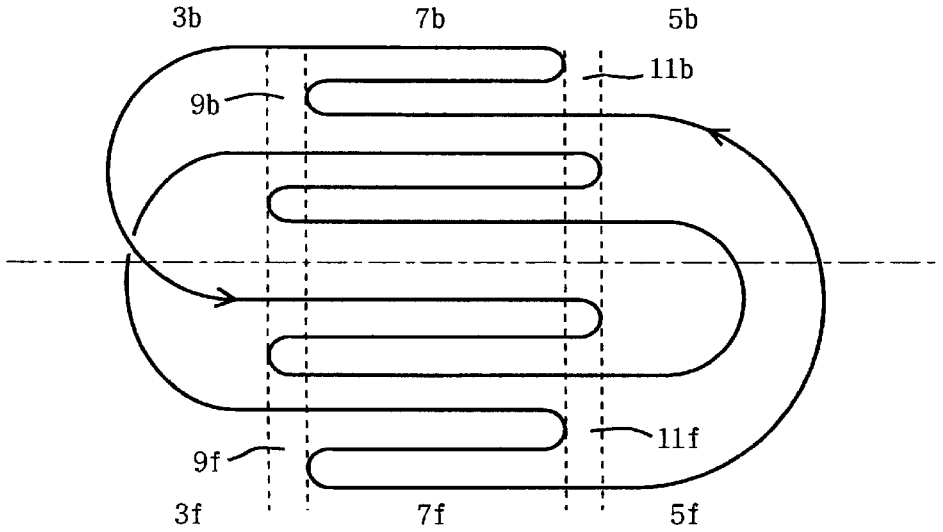
FIG. 5 shows the knitting sequence of a joint between the body and the sleeves in a modification.
Figure 6:
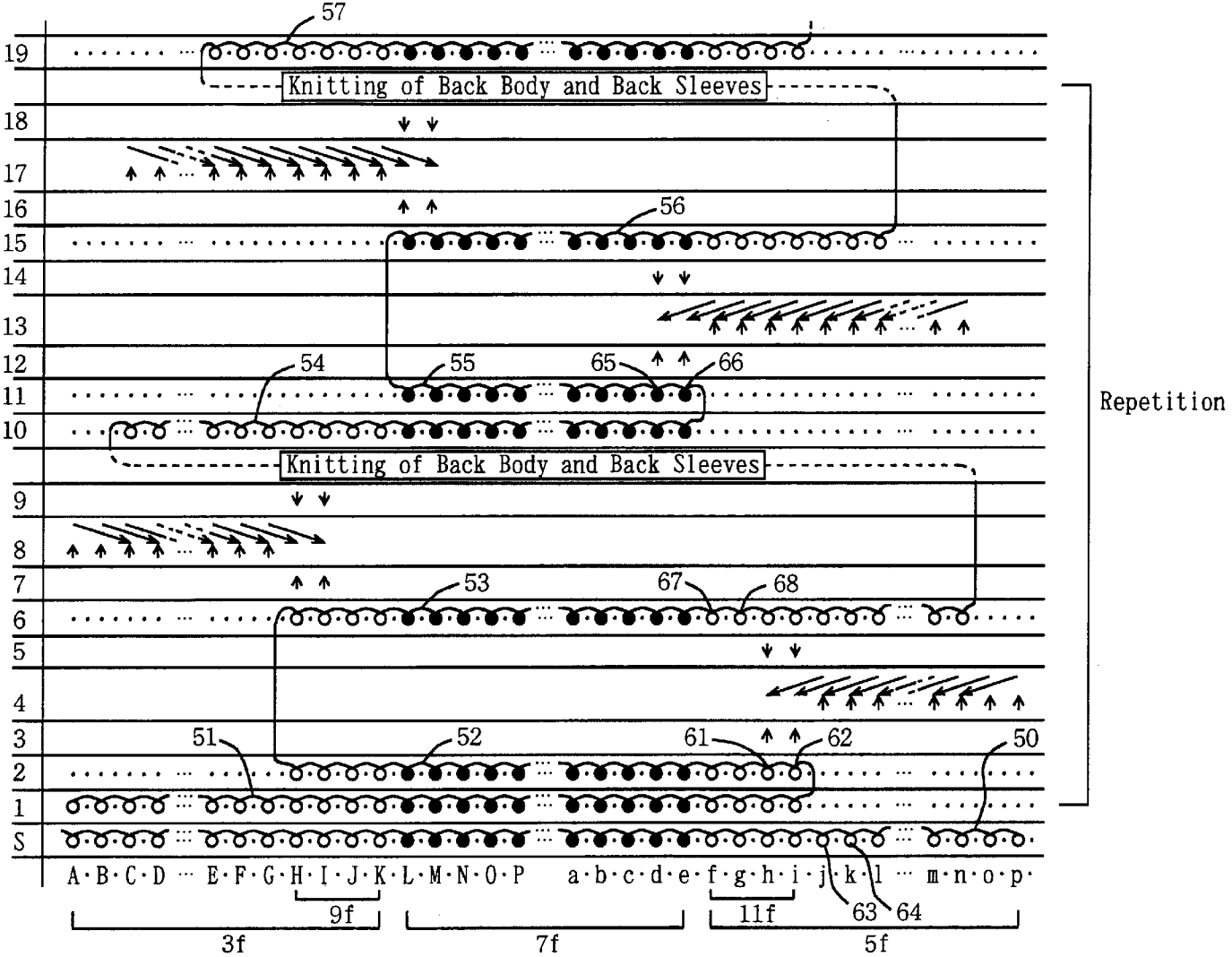
FIG. 6 shows the knitting steps of the front fabric side (front body, front right sleeve and front left sleeve) of FIG. 5.
Figure 7:
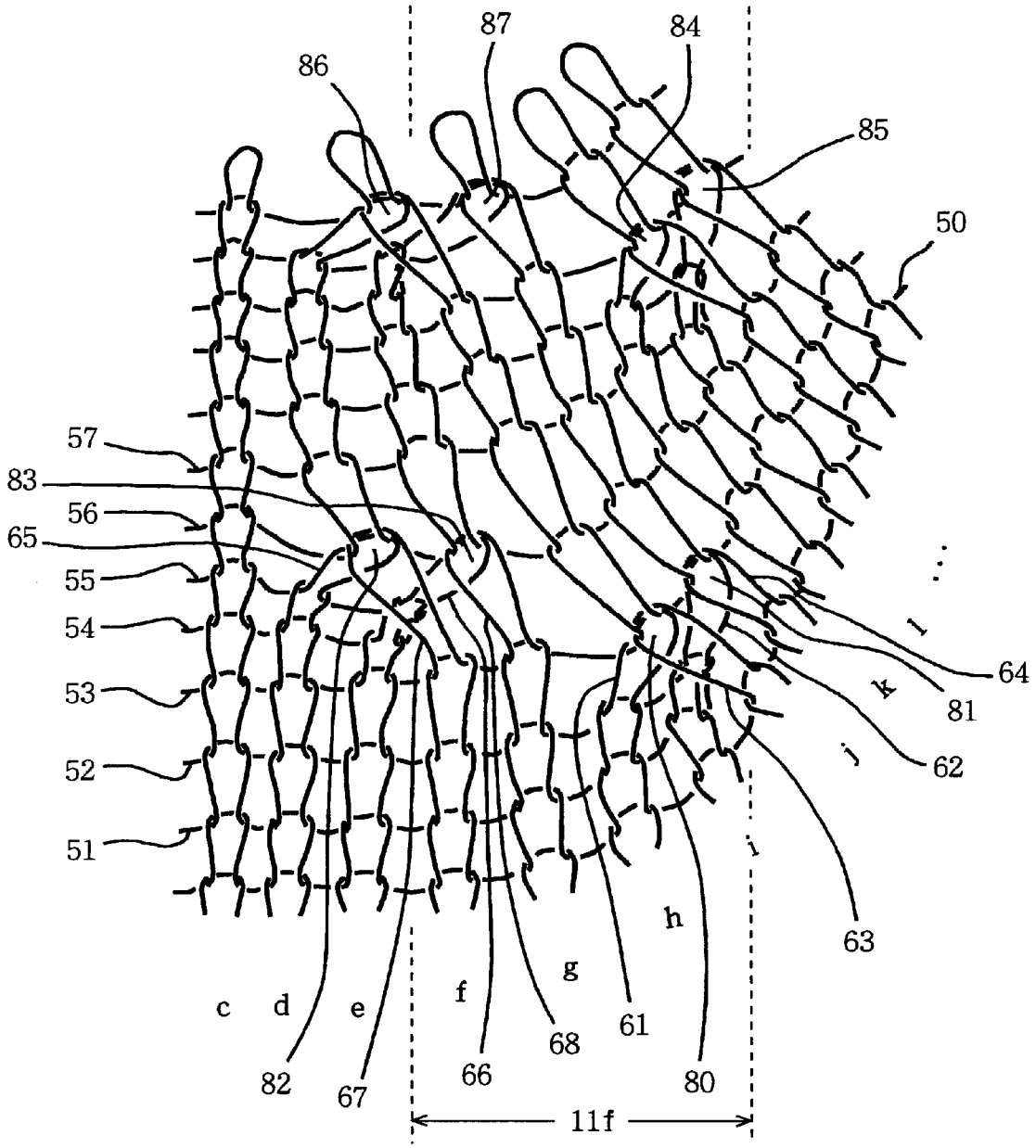
FIG. 7 shows the stitch loop structure of the correction between the left sleeve and the body knitted according to the knitted sequence of FIG. 5.
Figure 8B:
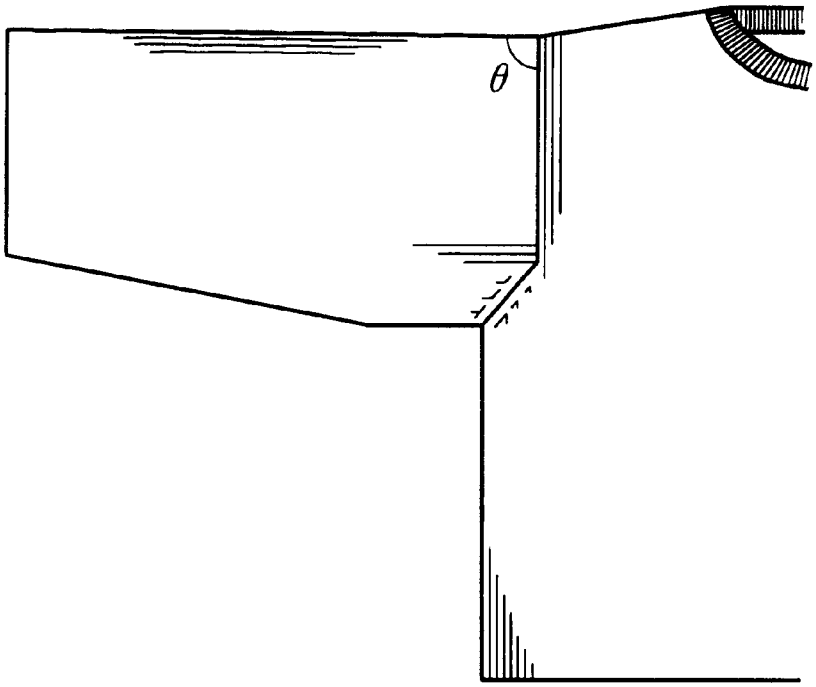
FIGS. 8A and B shows the state of a sleeve and a body of a T-sleeve pullover before joining and the state thereof after joining of the prior art.
FIG. 8-A shows the state before joining, and FIG. 8-B shows the state after joining.
Figure 8A:
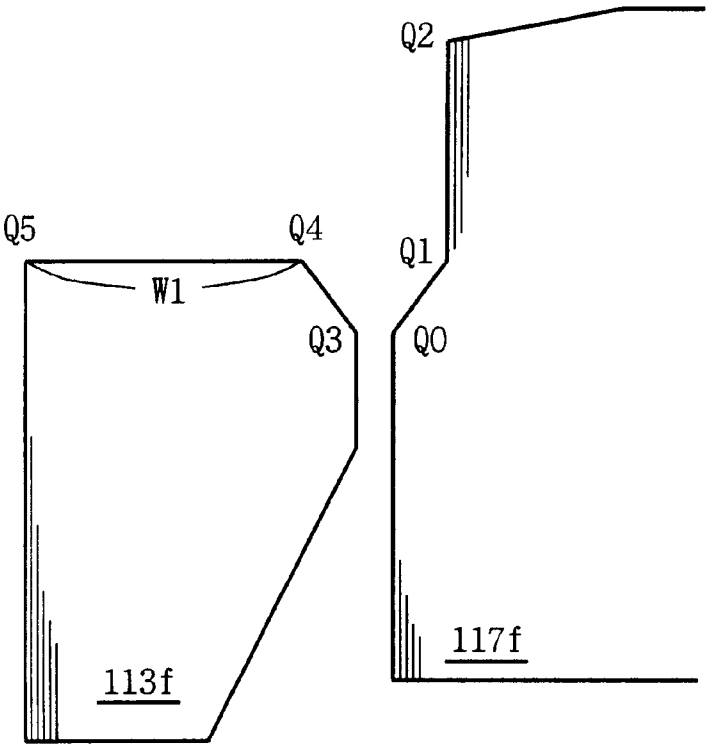
Prior Art FIG. 8A
Figure 9B:
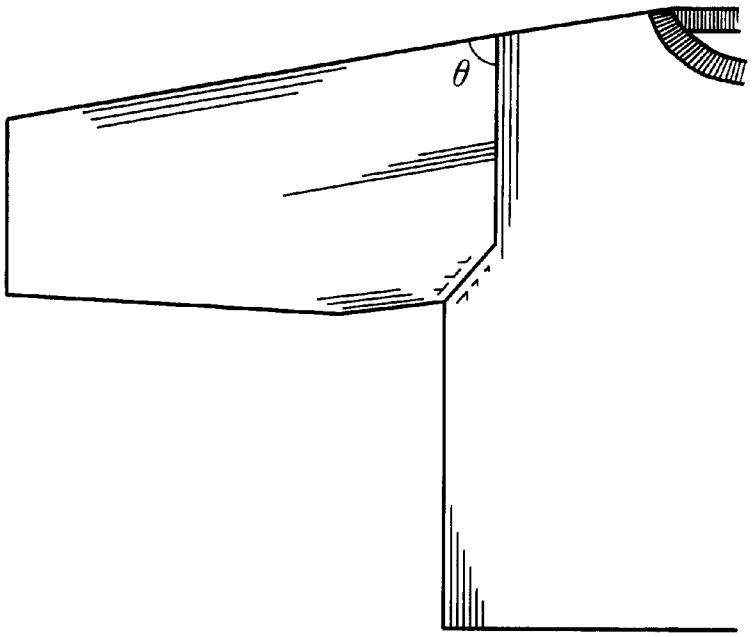
FIG. 9 shows the state of a sleeve and a body of a set-in sleeve pullover before joining and the state thereof after joining of the prior art.
Figure 9A:
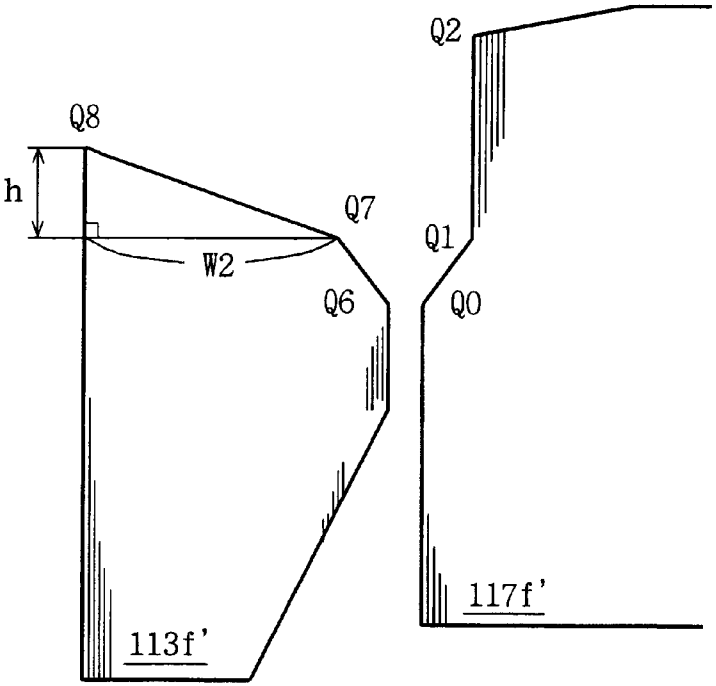
Prior Art FIG. 9A
Figure 10:
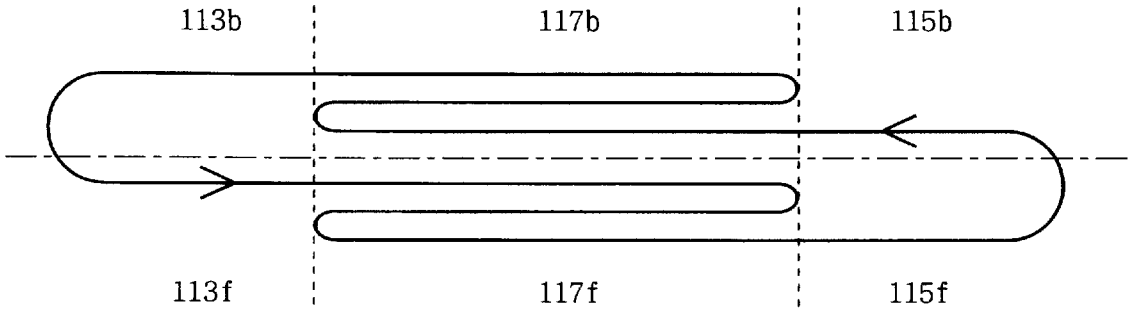
FIG. 10 shows the knitting sequence for joining the body and the sleeves of a set-in sleeve pullover in the prior art.
Figure 11:
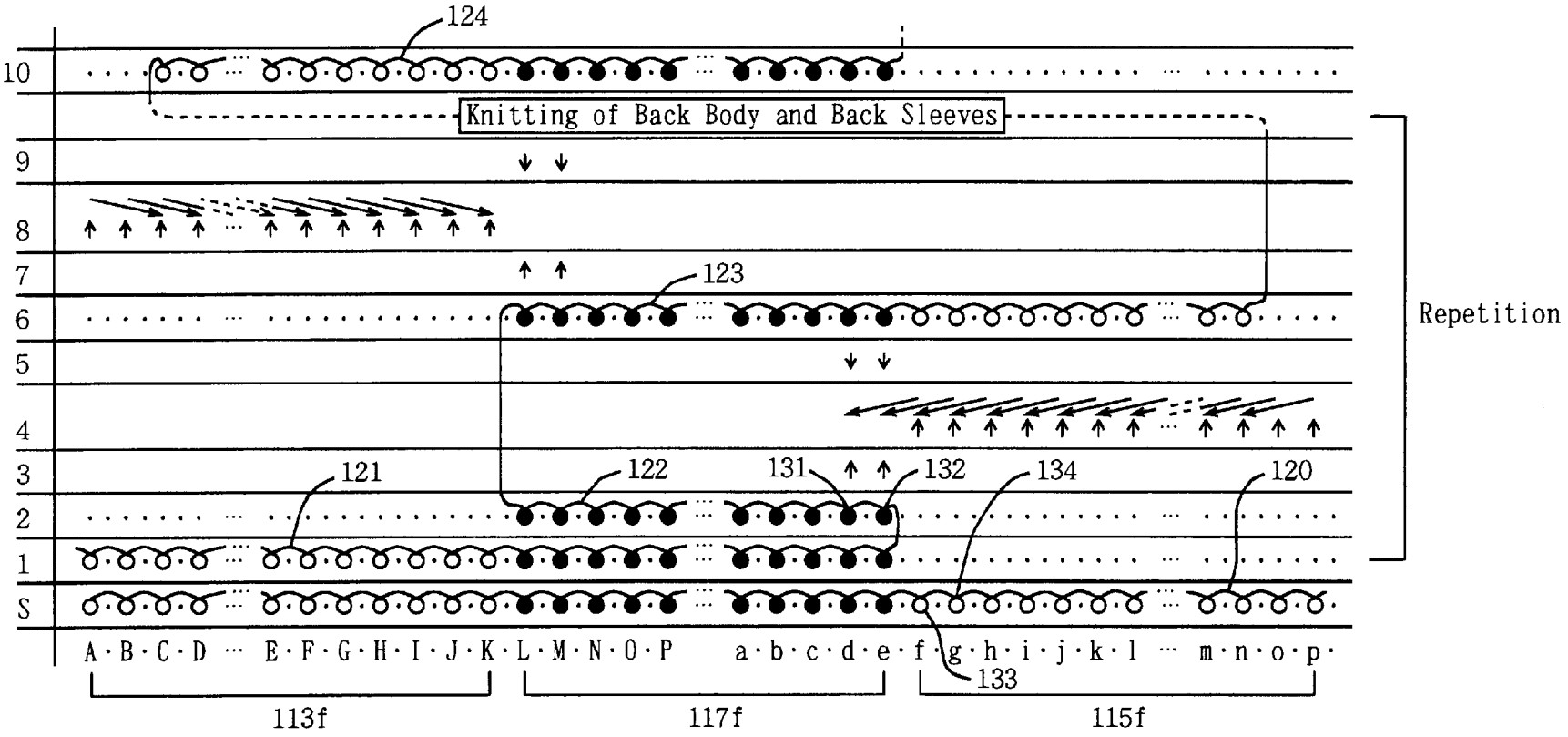
FIG. 11 shows the prior art knitting steps of the body and the sleeves on the front side of FIG. 10.

Next, a modification of the above-mentioned embodiment will be described with reference to FIG. 5 through FIG. 7. FIG. 5 shows, like FIG. 2, the sequence of joining knitting in the modified embodiment. When the yarn completes a round, six stitch courses are formed on each of the front body 7*f* and the back body 7*b*, two stitch courses on each of the front and back sleeves 3*f*, 3*b*, 5*f*, 5*b* except the edge portions, and four stitch courses on each of the sleeve edge portions 9*f*, 9*b*, 11*f*, 11*b*. FIG. 6 and FIG. 7 correspond to FIG. 3 and FIG. 4 of the above-mentioned first embodiment. FIG. 6 shows, in detail, the knitting steps of the front fabrics (front body, front right sleeve, and front left sleeve) of FIG. 5. FIG. 7 shows the stitch loop structure of the joint between the left sleeve 5*f* and the front body 7*f*. In the state S of FIG. 6, the holding condition of the body, sleeves and edge portions of sleeves on the needle bed is identical to that of the above-mentioned embodiment. The stitch course in the state S is indicated by mark 50 of FIG. 6.

First, in step 1, the yarn is fed to the needles A~c holding the stitches of the right sleeve 3*f* and the front body 7*f*, and the needles f~i holding the stitches of the edge portion 11*f* of the adjacent left sleeve to form a stitch course 51. In step 2, the yarn is shifted to the left to feed the yarn to the needles i~f holding the edge portion 11*f* of the left sleeve, the needles e~L holding the front body 7*f*, and the needles K~H holding the edge portion 9*f* of the right sleeve to form a stitch course 52 on the front body 7*f* and the edge portions 9*f*, 11*f* of both sleeves. In steps 3~5, the stitches being held on needles j~p of the left sleeve 5*f* except the edge portion 11*f* are shifted to the left, and the stitch being held on the needle j is overlapped with the stitch 61 being held on the needle h, and the stitch 64 being held on the needle k is overlapped with the stitch 62 being held on the needle i of the edge portion to form double stitches 80, 81. In steps 3, 5, the stitches 61, 62 of the edge portion are transferred to position the stitches 63, 64 being held on the needles j, k on the face side of the double stitches 80, 81. As a result, the knitting width of the front left sleeve 5*f* is reduced by two wales.

Next, in step 6, the yam is shifted to the right to feed the yarn to the needles H~K holding the edge portion 9*f* of the right sleeve, the needles L~e holding the front body 7*f*, and the needles f~p holding the left sleeve 5*f* to form a stitch course 53 on the respective parts. In steps 7~9, just like in steps 3~5 above, knitting of the front right sleeve 3*f* is made, and the knitting width of the front right sleeve 3*f* is reduced by two wales. After the completion of step 9, joining by knitting of the sleeves 3*b*, 5*b* on the back side and the body 7*b* is made. In step 10, the yarn is fed to needles C~e holding the left sleeve 3*f* and the front body 7*f* to form a stitch course 54. In step 11, the yarn is shifted to the left to feed the yarn to the needles e~L to form a stitch course 55 on the front body 7*f* only.

Subsequent steps 12~14 show joining by knitting between the left sleeve 5*f* and the front body 7*f*. The entire left sleeve 5*f* is shifted to the left, and the stitches 65, 66 being held on the needles d, e of the body 7*f* are overlapped with the stitches 67, 68 being held on the needles f, g of the sleeve. In steps 12, 14, the stitches 65, 66 of the body are transferred to position the stitches 67, 68 of the sleeve on the face side of the double stitches 82, 83. As a result, the knitting width of the front left sleeve is further reduced by two wales. In step 15, the yarn is shifted to the right to feed the yarn to the needles L~l to knit a stitch course 56 on the front body 7*f* and the left sleeve 5*f*. Steps 16~18 show, like steps 12~14 above, joining by knitting of the right sleeve 3*f* and the front body 7*f*, and the knitting width of the front right sleeve 3*f* is reduced further by two wales.

By these steps 1~18, six stitch courses are formed on the front body 7*f*, two courses on each of the sleeves 3*f*, 5*f*, and four courses on each of the sleeve edge portions 9*f*, 11*f*. Moreover, the knitting width of each sleeve is reduced by four wales as the stitches of the sleeve are overlapped with the stitches of the body or those of the edge portion of the sleeve. When this knitting is repeated, the sleeves and the body will be joined.

In both of the above-mentioned embodiments, explanation was given by way of example wherein the number of wales of the sleeve edge portion is four. The number of wales of the edge portion, however, is not limited to four. The number can be increased or decreased to some extent for improving the appearance of the joint or as far as the knitting width or shape is not affected. Preferably, the number of wales is from about 2 to about 10, in particular, from 2 to 10.

In the above-mentioned embodiments, as shown in the sequences of binding by knitting of FIG. 2 and FIG. 5, the ratio of number of stitch courses on the body and that on the sleeve formed by a single round of a single yarn was set at 3:1. However, the ratio of the number of stitch courses on the body and that on the sleeve may be changed, and plural yarns may be provided and different yarns may be used for the sleeves and the body, respectively. When knitting in such a way, if a sleeve joining angle close to that of T-sleeve is desired, the knitting ratio of stitch courses on the sleeve should be reduced. Conversely, if a smaller sleeve joining angle is desired, the knitting ratio of the stitch courses on the sleeve should be increased. In this way, a pullover with a desired sleeve joining angle can be obtained by modifying the knitting ratio of stitch courses on the body and those on the sleeve.

In the above-mentioned embodiments, explanation was given with an example of a pullover of which structure is solid plain stitch and of which sleeve type is set-in type. Hence, in its tubular knitting, sorting and transfer of stitches between the front needle bed and the rear needle bed are not required when the machine shifts from knitting of the front body to knitting of the back body or when the machine shifts from knitting of the back body to knitting of the front body. However, when a pullover of which design has a mixture of face stitchs and back stitchs, such as a wide rib, is knitted in a tubular form, it is necessary to add sorting and transfer processes. When fabrics not knitted in a tubular form are to be joined together, all needles can be used to knit them instead of using every other needle as shown in the above-mentioned embodiments. When two fabrics are to be joined, the above-mentioned joining by knitting can be used by assuming the first fabric as the body and the second fabric as the left sleeve.

The method of joining fabrics according to the present invention is not limited in any way to knitting of knit clothes such as pullover, nor to knitting of tubular fabrics. The present invention is applicable to joining of varied fabrics.

I claim:

1. A method of joining fabrics with use of a flat knitting machine wherein at least a pair of needle beds extending sidewise and opposing against each other, one in a front of the machine and the other in a rear of the machine, are provided, each of said pair of needle beds has a large number of needles, said pair of needle beds form a trick gap between them, at least one of said pair of needle beds can be racked sidewise, and stitches can be transferred between said pair of needle beds, said method of joining fabrics comprising:

(a) knitting a first fabric and a second fabric side by side by using specified needles of the needle beds;

(b) continuously feeding yarn to the needles holding the first fabric and the needles holding stitches of an edge portion of the second fabric, said edge portion being adjacent to the first fabric, to form a stitch course on the first fabric and the edge portion of the second fabric;

(c) overlapping, by stitch transferring, at least one stitch of the edge portion of the second fabric with at least one adjacent stitch of the same fabric to reduce the knitting width of the second fabric; and (d) overlapping, by stitch transferring, at least one stitch of the edge portion of the first fabric with at least one stitch of the edge portion of the second fabric to reduce the knitting width of the second fabric.

2. A method of joining fabrics of claim 1, wherein said at least one stitch each is one stitch each.

3. A method of joining fabrics of claim 1, wherein in step (c), two stitches of the edge portion of the second fabric are overlapped with two adjacent stitches of the second fabric.

4. A method of joining fabrics of claim 1, wherin in step (b), the yarn is fed to two to ten needles of the edge portion of the second fabric.

5. A method of joining fabrics of claim 1 wherein said first fabric consists of two fabrics which include a front fabric of a body and a back fabric of the body, and said second fabric consists of four fabrics which include a front fabric of a right sleeve, a back fabric of the right sleeve, a front fabric of a left sleeve and a back fabric of the left sleeve, said method of forming fabrics further comprises (e) in step (a), the front fabric of the body and the front fabric of the right sleeve, the front fabric of the body and the front fabric of the left sleeve, the back fabric of the body and the back fabric of the right sleeve, and the back fabric of the body and the back fabric of the left sleeve are knitted;

(f) in step (b), the front fabric of the body and the edge portion of the front fabric of the right sleeve on the side of the front fabric of the body, the front fabric of the body and the edge portion of the front fabric of the left sleeve on the side of the front fabric of the body, the back fabric of the body and the edge portion of the back fabric of the right sleeve on the side of the back fabric of the body, and the back fabric of the body and the edge portion of the back fabric of the left sleeve on the side of the back fabric of the body are knitted; and (g) through combination of steps (e), (f) the front fabric of the body and the back fabric of the body, and the front fabric of the right sleeve, the back fabric of the right sleeve, the front fabric of the left sleeve and the back fabric of the left sleeve, and edge portions of the front fabric of the right sleeve, the back fabric of the right sleeve, the front fabric of the left sleeve and the back fabric of the left sleeve on the side of the body are knitted.

6. A method of joining fabrics of claim 5, further comprising in step (e), at least one of:

knitting of only the front fabric of the body; and knitting of only the back fabric of the body.

* * * * *